United States Patent [19]

Sugasawa et al.

[11] 4,231,338

[45] Nov. 4, 1980

[54] INTERNAL COMBUSTION ENGINE

[75] Inventors: Fukashi Sugasawa, Yokohama; Haruhiko Iizuka, Yokosuka, both of Japan

[73] Assignee: Nissan Motor Company, Limited, Kanagawa, Japan

[21] Appl. No.: 43,123

[22] Filed: May 30, 1979 (Under 37 CFR 1.47)

[30] Foreign Application Priority Data

Dec. 28, 1978 [JP] Japan ..... 53-162547

[51] Int. CL[3] .....F02M 25/06; F01N 3/15

[52] U.S. Cl. ..... 123/568; 123/198 F; 60/278; 60/279

[58] Field of Search ..... 60/278, 279; 123/119 A, 123/198 F

[56] References Cited

U.S. PATENT DOCUMENTS

| | | | |
|---|---|---|---|
| 2,875,742 | 3/1959 | Dolza | 123/119 R |
| 3,756,205 | 9/1973 | Frost | 123/198 F X |
| 3,765,394 | 10/1973 | Francis | 123/198 F |
| 4,023,358 | 5/1977 | Maurer et al. | 123/198 F |
| 4,068,637 | 1/1978 | Takamiya | 60/278 |
| 4,094,286 | 6/1978 | Kuroda et al. | 60/278 |
| 4,106,471 | 8/1978 | Nakajima et al. | 123/198 F |
| 4,143,635 | 3/1979 | Iizuka et al. | 60/278 |
| 4,165,610 | 8/1979 | Iizuka et al. | 123/198F |
| 4,184,470 | 1/1980 | Iizuka | 123/198 F |

*Primary Examiner*—Wendell E. Burns

*Attorney, Agent, or Firm*—Schwartz, Jeffery, Schwaab, Mack, Blumenthal & Koch

[57] ABSTRACT

An internal combustion engine is disclosed which comprises a plurality of cylinders split into first and second groups, the first group of cylinders held in operation independently of engine load conditions, the second group of cylinders having no supply of fuel and fresh air so as to be placed out of operation when the engine is under low load conditions, an exhaust passage connected to the exhaust ports of the first and second groups of cylinders, a sensor provided within the exhaust passage for detecting the oxygen concentration of the exhaust gases passing through the exhaust passage, control means responsive to an output of the sensor for controlling the air/fuel ratio of a mixture produced in each cylinder to an optimum value, an exahust gas purifier provided in the exhaust passage for purifying the exhaust gases passing through the exhaust passage, an exhaust gas recirculation passage having its one end connected to the intake passage of the second group of cylinders and the other end connected to the exhaust passage in arrear of the exhaust gas purifier, and valve means provided in the EGR passage which is open to allow recirculation of exhaust gases through the EGR passage when the engine is under low load conditions.

3 Claims, 3 Drawing Figures

INTERNAL COMBUSTION ENGINE

BACKGROUND OF THE INVENTION

1. Field of the Invention

This invention relates to an internal combustion engine of the type including a plurality of cylinders split into first and second groups, the first group of cylinders held in operation independently of engine load conditions, and the second group of cylinders having no supply of fuel and fresh air so as to be placed out of operation when the engine is under low load conditions. The invention is more particularly concerned with an exhaust gas recirculation system for use with such a split engine for recirculation of a great amount of exhaust gases into the suspended cylinders while the engine is running under low load conditions.

2. Description of the Prior Art

Generally, there is a tendency of an internal combustion engine such that it consumes a smaller amount of fuel under a higher load condition. For the sake of high fuel economy under low load conditions, split engines have been deviced which run in a partial-cylinder mode of operation when they are under low load conditions. During this partial-cylinder mode of operation, some of the cylinders have no supply of fuel and fresh air and have their operation suspended so that the remainder of the cylinders can operate under resulting increased load conditions.

An exhaust gas recirculation system has been associated with such a split engine for recirculating a great amount of of exhaust gases into the suspended cylinders so as to reduce the pumping loss of the suspended cylinders which results in a greater fuel economy.

Conventional split engines are not very efficient and relatively high particularly while the engine is running under low load conditions. The conventional exhaust gas recirculation systems do not provide optimum performance of these engines.

SUMMARY OF THE INVENTION

It is therefore one object of the present invention to provide an improved internal combustion engine operable with higher efficiency and fuel economy.

Another object of the present invention to provide an improved internal combustion engine where the exhaust has a minimam level of air pollutants.

Still another object of the present invention to provide an efficient exhaust gas recirculation system for a split engine which permits accurate air/fuel ratio control over a wide range of engine load conditions.

These and other objects of the present invention are attained by providing an internal combustion engine which comprises a plurality of cylinders split into first and second groups, the first group of cylinders held in operation independently of engine load conditions, the second group of cylinders having no supply of fuel and fresh air so as to be placed out of operation when the engine is under low load conditions, an exhaust passage connected to the exhaust ports of the first and second groups of cylinders, a sensor provided within the exhaust passage for detecting the oxygen concentration of the exhaust gases passing through the exhaust passage, control means responsive to an output of the sensor for controlling the air/fuel ratio of a mixture produced in each cylinder to an optimum value, an exhaust gas purifier provided in the exhaust passage for purifying the exhaust gases passing through the exhaust passage, an exhaust gas recirculation passage having its one end connected to the intake passage of the second group of cylinders and the other end connected to the exhaust passage in arrear of the exhaust gas purifier, and valve means provided in the EGR passage which is open to allow recirculation of exhaust gases through the EGR passage when the engine is under low load conditions.

BRIEF DESCRIPTION OF THE DRAWINGS

For a better understanding of the present invention, as well as other objects and further features thereof, reference is had to the following detailed description of the invention to be read in connection with the accompanying drawings, in which.

DETAILED DESCRIPTION OF THE INVENTION

Figure 1:
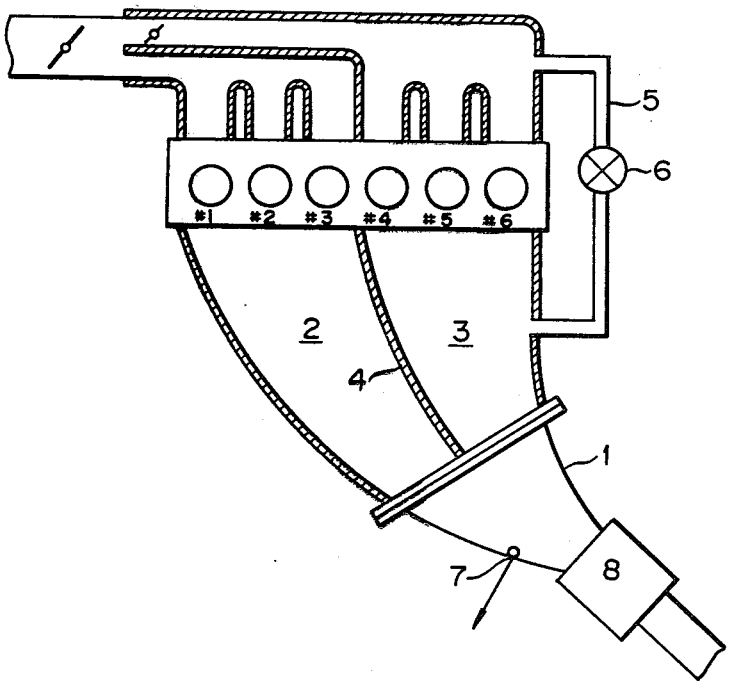
FIG. 1 is a schematic sectional view showing a conventional internal combustion engine of the split type.

Referring first to FIG. 1, there is illustrated a conventional split engine which comprises a first group of cylinders #1 to #3 held in operation independently of engine load conditions and a second group of cylinders #4 to #6 having their operation suspended while the engine is running under low load conditions. An exhaust passage 1 is provided which has an upstream portion divided into first and second passages 2 and 3 by a partition 4 and a downstream portion communicating with the first and second exhaust passages 2 and 3. Thus, the exhaust gases discharged from the first and second groups of cylinders flow separately through the first and second exhaust passages 2 and 3, respectively, and then flow together through the joined portion of the exhaust passage 1. An exhaust gas recirculation passage 5 is provided for passing exhaust gases from the second exhaust passage 3 into the intake passage of the second group of cylinders #4 to #6. An EGR valve 6 is disposed in the EGR passage 5 which is open when the engine is under low load conditions to permit recirculation of exhaust gases through the EGR passage.

An oxygen concentration sensor 7 is provided within the joined portion of the exhaust passage 1 for detecting the oxygen concentration of the exhaust gases passing therethrough. The output of the sensor 7 is used to induce the air/fuel ratio of the mixtures which have been burnt into the exhaust gases causing the sensor 7 to provide the output. The induced air/fuel ratio is utilized to control the air/fuel ratio to be produced in each cylinder to an optimum value. The exhaust gases are discharged through a catalyzer 8 to the atmosphere. The catalyzer 8 provides its optimum performance when the air/fuel ratio in every cylinder is optimum.

With such an exhaust gas recirculation system, the exhaust gas flow passing through the joined portion of the exhaust passage 1 is a combination of the exhaust gases discharged from the first group of cylinders #1 to #3 through the first exhaust passage 2 thereinto and the exhaust gases recirculated through the EGR passage 5 into the second group of cylinders #4 to #6 and hence through the second exhaust passage 3 thereinto when the engine is under low load conditions. The second described exhaust gases are products caused by a combustion taken place in the cylinders a long time before the combustion producing the first described exhaust gases. This means that the sensor 7 is exposed to a mixture of exhaust gases produced at different times so that the air/fuel ratio derived from the oxygen concentration of the exhaust gases detected by the sensor 7 will not be matched with the real air/fuel ratio of the mixture produced in each cylinder. Thus, it is impossible to achieve any accurate air/fuel ratio control. This results in poor engine performance and also poor catalyzer performance.

Figure 2:
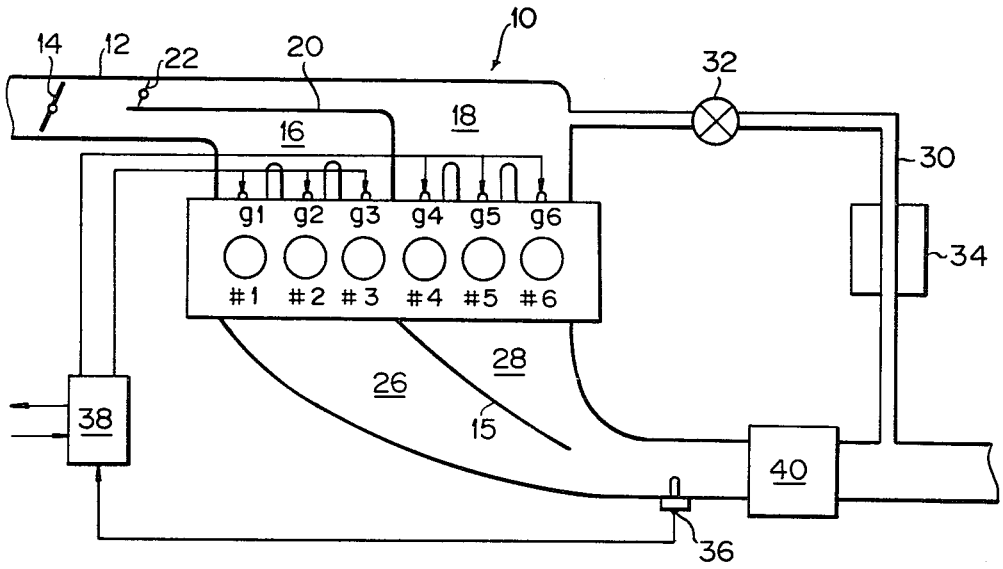
FIG. 2 is a schematic sectional view showing one embodiment of an internal combustion engine constructed in accordance with the present invention.

Referring now to FIG. 2, there is schematically illustrated an internal combustion engine 10 made in accordance with the present invention. The engine 10 includes an intake passage 12 having therein a throttle valve 14 and having its downstream portion divided into first and second intake passages 16 and 18 by a partition 20. The first intake passage 16 communicates with a first group of cylinders #1 to #3 and the second intake passage 18 communicates with a second group of cylinders #4 to #6 which have no supply of fuel and fresh air so as to have their operation suspended when the engine is under low load conditions. The first intake passage 18 has therein a valve 22 which is closed to prohibit the supply of fresh air to the second group of cylinders #4 to #6 when the engine is under low load conditions.

An exhaust passage 24 is provided which has an upstream portion divided into first and second exhaust passages 26 and 28 and a downstream portion at which the first and second exhaust passages 26 and 28 join. The first exhust passage 26 communicates with the exhaust ports of the first group of cylinders #1 to #3 and the second exhaust passage 28 communicates with the exhaust ports of the second group of cylinders #4 to #6.

An exhaust gas recirculation passage 30 has its one end connected to the second intake passage 18 and the other end connected to the joined portion of the exhaust passage 24 for recirculation of a great amount of exhaust gases from the exhaust passage 24 into the second group of cylinders #4 to #6 thereby to reduce the pumping loos of the suspended cylinders #4 to #6. An EGR valve 32 is provided in the EGR passage 30 which is open to allow recirculation of exhaust gases through the EGR passage 30 when the engine is under low load conditions.

An oxygen concentration sensor 36 is provided within the joined portion of the exhaust passage 24 which serves to detect the oxygen concentration of the exhaust gases flowing therethrough. The output of the sensor 36 is coupled to a control circuit 38. On the basis of the output of the sensor 36, the control circuit 38 induces the air/fuel ratio of the mixtures which have been burnt into the exhaust gases causing the sensor 36 to provide the output and controls the length of time of opening of the fuel injection valve g1 to g6 of the cylinders so as to make correction for the fuel injection amount determined mainly by the engine intake air amount and engine speed to an optimum value.

Further, the control circuit 38 induces the engine load condition on the basis of the intake air amount and provides signals to place out of operation the fuel injection valves g4 to g6 of the second group of cylinders #4 to #6, close the valve 22 and open the EGR valve 32 when the engine is under low load conditions. The control circuit 38 provides signals to operate the fuel injection valves g4 to g6, open the valve 22 and close the EGR valve 32 when the engine is under middle or high load conditions.

Figure 3:
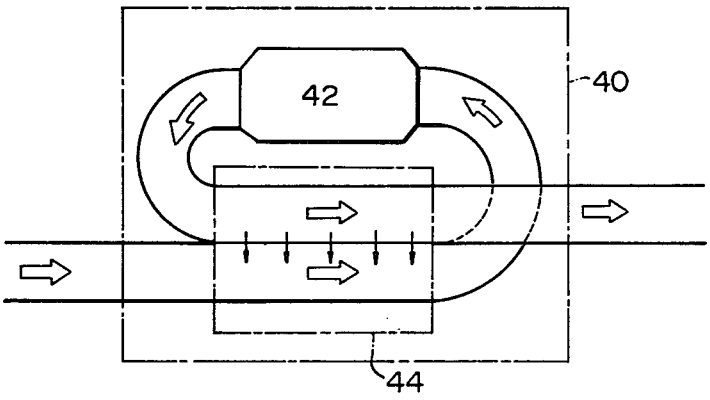
FIG. 3 is a schematic enlarged view showing the detailed structure of the exhaust gas purifier of FIG. 2.

An exhaust gas purifier 40 is provided in the joined portion of the exhaust passage 24 in arrear of the sensor 36 and in advance of the opening of the EGR passage 30. As shown in detail in FIG. 3, the exhaust gas purifier 40 comprises a catalyzer 42 and a heat-exchanger 44. The catalyzer 42 serves to oxidize hydrocarbons and carbon monoxide and nitrogen oxides so as to remove undesirable components from the exhaust gases introduced into the exhaust gas purifier 40. The heat-exchanger 44 performs heat-exchange between the exhaust gases discharged from the catalyzer 42 and the exhaust gases to be introduced into the catalyzer 42 so as to increase the temperature of the second described exhaust gases. This increases the efficiency of oxidization and deoxidization of the catalyzer 42 such that the oxygen concentration of the exhaust gases discharged from the exhaust gas purifier 40 can be reduced substantially at zero. In FIG. 3, the thick arrows indicate exhaust gas flow and the solid arrows indicate heat transmission.

It is preferable to provide a cooler 34 in the EGR passage 30 in advance of the EGR valve 32 for cooling the exhaust gases excessively heated upon their oxidization in the catalyzer 42 to prevent production of an excessive temperature gradient and thermal strains in the intake passage 12 causing reduction of its service life.

The operation of the internal combustion engine of the present invention will now be described. Assuming that the engine is running under middle or high load conditions, the control circuit 38 detects this to close the EGR valve 32, open the valve 22 and operate the fuel injection valves g4 to g6 so as to allow the supply of fuel and fresh air into all of the cylinders #1 to #6 to place them in operation. During this full-cylinder mode of operation, the oxygen concentration sensor 36 is exposed to a combination of the exhaust gases discharged from the first group of cylinders #1 to #3 through the first exhaust passage 26 into the joined portion of the exhaust passage 24 and the exhaust gases discharged from the second group of cylinders #4 to #6 through the second exhaust passage 28 into the joined portion of the exhaust passage 24. Since the first and second described exhaust gases are produced at the same time in the cylinders #1 to #6, the air/fuel ratio derived from the oxygen concentration of the exhaust gases detected by the sensor 36 is close enough to provide accurate air/fuel ratio control. As a result, the engine can run with optimum engine efficiency and optimum catalyzer efficiency to fully remove undesirable components from the exhaust gases.

Assuming that the engine is running under low load conditions, the control circuit 38 detects this to open the EGR valve 32, close the valve 18 and place out of operation the fuel injection valves g4 to g6 so as to suspend the supply of fuel and fresh air to the second group of cylinders #4 to #6 and simultaneously to recirculate a great amount of exhaust gases from the exhaust passage 24 into the second group of cylinders #4 to #6. The recirculated exhaust gases have substantially no oxygen after they pass through the exhaust gas purifier 40 and are cooled to a suitable temperature by the cooler 34. During this partial-cylinder mode of operation, suspension of the second group of cylinders #4 to #6 permits the first group of cylinders #1 to #3 to operate under increased load conditions resulting in greater fuel economy, and also recirculation of a great amount of exhaust gases into the suspended cylinders #4 to #6 permits reduction of the pumping loss of the suspended cylinders #4 to #6 resulting in still greater fuel economy.

During the partial-cylinder mode of operation, the sensor 36 is exposed to a combination of the exhaust gases discharged from the first group of cylinders #1 to #3 through the first exhaust passage 26 into the joined portion of the exhaust passage 24 and the exhaust gases recirculated through the EGR passage 30 into the second group of cylinders #4 to #6 and hence through the second exhaust passage 28 into the joined portion of the exhaust passage 24. Since the second described exhaust gases have no oxygen as described above although they are produced a long time before production of the first described exhaust gases, the sensor 36 detects oxygen included only in the first described exhaust gases which are discharged into the joined portion of the exhaust passage 24 from the operative cylinders #1 to #3 just after combustion is taken place in these cylinders. Thus, the accurate oxygen concentration of the exhaust gases discharged from the operative cylinders through the first exhaust passage 26 into the joined portion of the exhaust passage 24 can easily be derived from the oxigen concentration detected by the sensor 36, the proportion of the amounts of the first and second described exhaust gases. Thus, it is possible to achieve accurate air/fuel ratio control. As a result, the engine can runs with optimum engine output efficiency and optimum catalyzer efficiency to fully remove undesirable components from the exhaust gases even when the engine is under low load consitions.

While the present invention has been described with reference to a preferred embodiment, it will be understood by those skilled in the art that various changes may be made and equivalents may be substituted for elements thereof without departing from the spirit and scope of the invention.

What is claimed is:

1. An internal combustion engine comprising a plurality of cylinders split into first and second groups, said first group of cylinders held in operation independently of engine load conditions, said second group of cylinders having no supply of fuel and fresh air so as to be placed out of operation when said engine is under low load conditions, an exhaust passage connected to the exhaust ports of said first and second groups of cylinders, a sensor provided within said exhaust passage for detecting the oxygen concentration of the exhaust gases passing through said exhaust passage, control means responsive to an output of said sensor for controlling the air/fuel ratio of a mixture produced in each cylinder to an optimum value, an exhaust gas purifier provided in said exhaust passage for purifying the exhaust gases passing through said exhaust passage, an exhaust gas recirculation passage having its one end connected to the intake passage of said second group of cylinders and the other end connected to said exhaust passage in arrear of said exhaust gas purifier, and valve means provided in said EGR passage which is open to allow recirculation of exhaust gases through said EGR passage when said engine is under low load conditions.

2. An internal combustion engine as set forth in claim 1, wherein said purifier comprises a catalyzer oxidizing hydrocarbons and carbon monoxide and deoxidizing oxides of nitrogen and a heat-exchanger for transmitting the heat of the exhaust gases discharged from said catalyzer to the exhaust gases which is to be introduced into said catalyzer.

3. An internal combustion engine as set forth in claim 1, which further comprises an exhaust gas cooler provided in said EGR passage for reducing the temperature of the exhaust gases flowing through said EGR passage.

* * * * *